US005979176A

United States Patent [19]

Stables et al.

[11] Patent Number: 5,979,176

[45] Date of Patent: Nov. 9, 1999

[54] REFRIGERATOR

[75] Inventors: Gary Stables; Kevin William John Timms, both of Oxon; Peter Derek Daniels, Northamptonshire, all of United Kingdom

[73] Assignee: Oxford Instruments (UK) Limited, Oxon, United Kingdom

[21] Appl. No.: 09/031,738

[22] Filed: Feb. 27, 1998

[30] Foreign Application Priority Data

Feb. 19, 1998 [EP] European Pat. Off. ..... 98301222

[51] Int. Cl.[6] ..... F25B 19/00

[52] U.S. Cl. ..... 62/610; 62/51.1

[58] Field of Search ..... 62/610, 51.1

[56] References Cited

U.S. PATENT DOCUMENTS

| | | | |
|---|---|---|---|
| 2,982,106 | 5/1961 | Ambler | 62/610 |
| 4,510,771 | 4/1985 | Matsuda et al. . | |
| 4,689,439 | 8/1987 | Sato | 62/610 |
| 4,891,951 | 1/1990 | Ishibashi . | |
| 4,956,976 | 9/1990 | Kral et al. | 62/610 |
| 5,410,286 | 4/1995 | Herd et al. . | |

FOREIGN PATENT DOCUMENTS

| | | |
|---|---|---|
| 23 52 147 | 4/1975 | Germany . |
| 1 215 979 | 12/1970 | United Kingdom . |
| 1 347 111 | 2/1974 | United Kingdom . |

OTHER PUBLICATIONS

Patent Abstracts of Japan, vol. 008, No. 095 (E–242), May 2, 1984 & JP 59 013308 A (Tokyo Shibaura Denki KK), Jan. 24, 1984.

Patent Abstracts of Japan, vol. 011, No. 041 (E–478), Feb. 6, 1987 & JP 61 208206 A (Mitsubishi Electric Corp.), Sep. 16, 1986.

*Primary Examiner*—Ronald Capossela

[57] ABSTRACT

A refrigerator for cooling a sample (16,17) comprising a reservoir (1) for storing gaseous $^4$He when in use; a cooler (13) for cooling gaseous $^4$He from the reservoir; and a helium vessel (18,19) for containing $^4$He, the $^4$He in the helium vessel being in fluid communication with the reservoir (1) via the cooler (13). The sample (16,17) is mounted, in use, in thermal contact with the $^4$He in the helium vessel whereby the $^4$He in the helium vessel provides a path for heat to transfer from the sample to the cooler.

21 Claims, 6 Drawing Sheets

REFRIGERATOR

FIELD OF THE INVENTION

The present invention relates to a refrigerator for cooling a sample.

DESCRIPTION OF THE PRIOR ART

A number of refrigerators are known for cooling a sample to very low temperatures.

In one known refrigerator a sample is immersed in a bath of liquid $^4$He. Heat energy is efficiently removed from the sample by conduction and convection in the liquid $^4$He, and absorbed by the latent heat of evaporation of the $^4$He. However this system suffers from a number of problems. Firstly, as the $^4$He evaporates the bath must be regularly refilled with liquid $^4$He from a storage dewar to ensure that the sample remains fully immersed. Secondly, a large volume of liquid $^4$He is required to fully immerse the sample, and to minimise the required refill frequency. Thirdly, if the sample heats up suddenly sudden evaporation of liquid $^4$He can cause a dangerous increase in pressure above the liquid. Fourthly, when the bath is full it is not possible to invert the system.

In an attempt to solve these problems, a "cryogen free" system has been developed by Oxford Instruments and is sold as the Tesla 78 mm room temperature bore cryofree magnet ref Cryof5/78. The cryofree system comprises a cooling engine which provides a cold stage at a temperature of 4.2 K. The sample is shielded from room temperature radiation by a radiation shield and a vacuum space. The sample and radiation shield are connected to the cold stage by thermally conductive links, such as copper flanges. Although no helium cryogen is required, this system suffers from a number of problems. Firstly, the system takes a long time to cool down from room temperature. Secondly, the system cannot absorb large or sudden heat loads efficiently due to the limited finite refrigeration power of the cooling engine. Thirdly, if the cooling engine suffers a loss of power the system warms up very quickly. Fourthly, conventional cooling engines cannot cool the sample down to liquid $^4$He temperatures (ie. of the order of 4 K).

SUMMARY OF THE INVENTION

In accordance with a first aspect of the present invention there is provided a refrigerator for cooling a sample comprising a reservoir for storing gaseous $^4$He when in use; a cooler for cooling gaseous $^4$He from the reservoir; and a helium vessel in fluid communication with the reservoir via the cooler, wherein the helium vessel contains $^4$He in use, and wherein the sample is mounted, in use, in thermal contact with the $^4$He in the helium vessel whereby the $^4$He in the helium vessel provides a path for heat to transfer from the sample to the cooler.

In accordance with a second aspect of the present invention there is provided a method of cooling a sample comprising providing a reservoir of gaseous $^4$He; cooling gaseous $^4$He from the reservoir with a cooler; providing $^4$He in a helium vessel; mounting a sample in thermal contact with the $^4$He in the helium vessel; and transferring heat from the sample to the cooler along a path provided by the $^4$He in the helium vessel.

The present invention provides a number of significant advantages over conventional refrigerators. Firstly the refrigerator utilizes the cooling properties of $^4$He whilst using a significantly smaller volume of $^4$He than in a conventional liquid $^4$He bath system. Secondly the helium vessel and reservoir together form a closed volume which does not require refilling with $^4$He. Thirdly if the sample heats up quickly then $^4$He can expand safely from the helium vessel into the reservoir without creating a dangerous increase in pressure.

The cooler may cool the $^4$He down to approximately 20 K, above the boiling point of $^4$He. In this case all of the $^4$He in the refrigerator will be gaseous. However preferably the cooler has sufficient cooling power to cause gaseous $^4$He to condense and flow into the helium vessel. This takes advantage of the more efficient heat transfer properties of liquid $^4$He. For instance the liquid $^4$He can wet the sample and thus removes "hot spots" on the sample more efficiently. In addition the condensed $^4$He adds significantly to the cold thermal mass hence improving immunity to temperature fluctuations.

The sample may be housed in the helium vessel, ie. in contact with the $^4$He. Alternatively the sample may be housed in a sample chamber outside the helium vessel, and thermally connected to the $^4$He in the helium vessel by a thermally conductive link.

Any suitable cooler may be used but typically the cooler comprises a cooling engine such as a closed-cycle cryogenic cooler. In a preferred example the cooler comprises a Gifford-McMahon cycle cryogenic cooler.

Typically the refrigerator further comprises a radiation shield which shields the sample from external radiation. In this cases the cooler preferably also cools the radiation shield.

Due to the reduced volume of $^4$He (when compared with a conventional helium bath) the refrigerator can take a long time to cool down from room temperature. Therefore preferably the refrigerator further comprises a liquid nitrogen precooling system for precooling of the refrigerator with liquid nitrogen.

The liquid nitrogen precooling system may precool the radiation shield and/or the sample.

The cool down time can also be reduced by providing one or more additional coolers for cooling the sample and/or the radiation shield.

Typically the volume of the helium vessel is chosen such that the total volume of $^4$He in use in the helium vessel is less than 5 liters, and preferably less than 2 liters. If the sample is housed in the helium vessel then this volume will be the volume between the sample and an inner periphery of the helium vessel. In this case the area of the sample which is contacted by helium is typically greater than 1 $m^2$. In a preferred example the volume is between 1 and 2 liters.

In the case where the cooler condenses the $^4$He, then equivalently the volumes of the helium vessel and the cryogen reservoir are chosen such that the total volume of liquid $^4$He which flows into the helium vessel does not exceed 5 liters and preferably does not exceed 2 liters. In a preferred example the condensed volume is between 1 and 2 liters.

In a preferred embodiment a solid high thermal conductivity link is also provided to give an additional path for heat to transfer from the sample to the cooler.

Any sample may be cooled by the refrigerator but preferably the sample comprises a superconducting magnet. The efficient thermal transport properties of $^4$He are particularly suited to this application where it is important to cool localised hot spots which may be caused by eddy current heating. In addition if the magnet quenches the refrigerator can easily absorb the sudden heat load and the evaporating $^4$He can expand safely into the reservoir without creating a dangerous increase in pressure.

The magnet may be formed of a material comprising $Nb_3Sn$. However this material is expensive and preferably the magnet is formed of a material comprising NbTi.

BRIEF DESCRIPTION OF THE DRAWINGS

An example of the present invention will now be described with reference to the accompanying drawings, in which.

DETAILED DESCRIPTION OF THE EMBODIMENT

Figure 1:
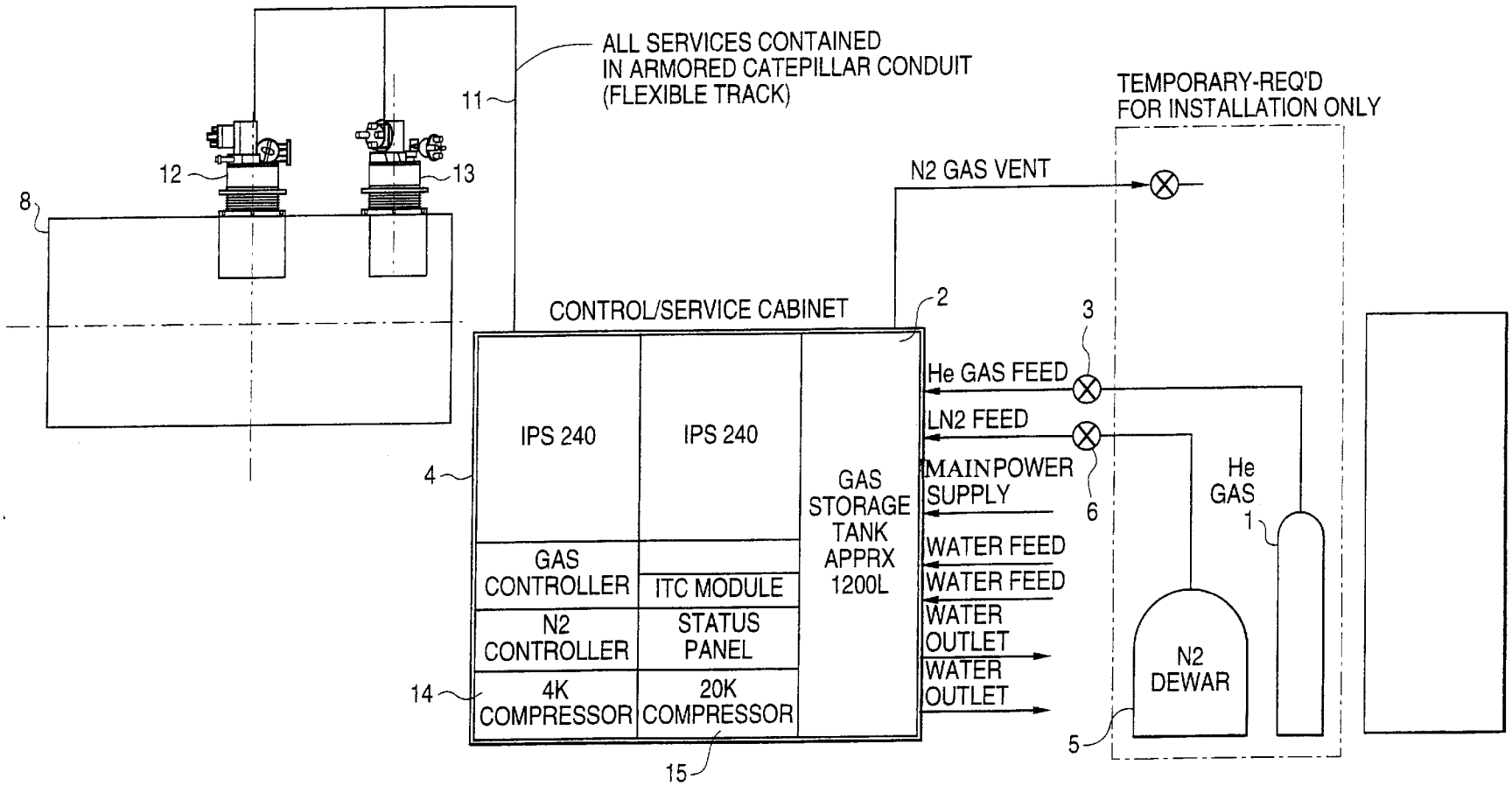
FIG. 1 is a first schematic diagram of an example of a refrigerator according to the present invention.

Referring to FIG. 1, a helium gas cylinder 1 supplies helium gas to a 1200 liter capacity gas storage tank 2 under the control of a helium gas feed valve 3. The gas storage tank 2 stores enough gas at room temperature to condense into 1–2 liters of liquid helium at 4.2 K. The gas storage tank 2 is housed in a control/service cabinet 4. A liquid nitrogen dewar 5 supplies liquid nitrogen to the control/service cabinet 4 via a nitrogen feed valve 6.

A superconducting magnet (not shown in FIG. 1) is cooled by the system and housed in outer vacuum casing 8. Primary cooling power is provided by a 4 K Gifford-McMahon cycle cryogenic cooler comprising a cold head 13 and a compressor 14. An example of a suitable 4 K cryogenic cooler is the Sumitomo Heavy Industries, Ltd SRDK-408DW rare-earth enhanced cryocooler, comprising a model RDK-408D cold head, and a model CSW71B compressor. Secondary cooling power is provided by a 20 K Gifford-McMahon cycle cryogenic cooler comprising a cold head 12 and compressor 15. All gas and electrical supply lines are contained in an armoured caterpillar conduit 11, as illustrated in more detail in FIG. 2.

Figure 2:
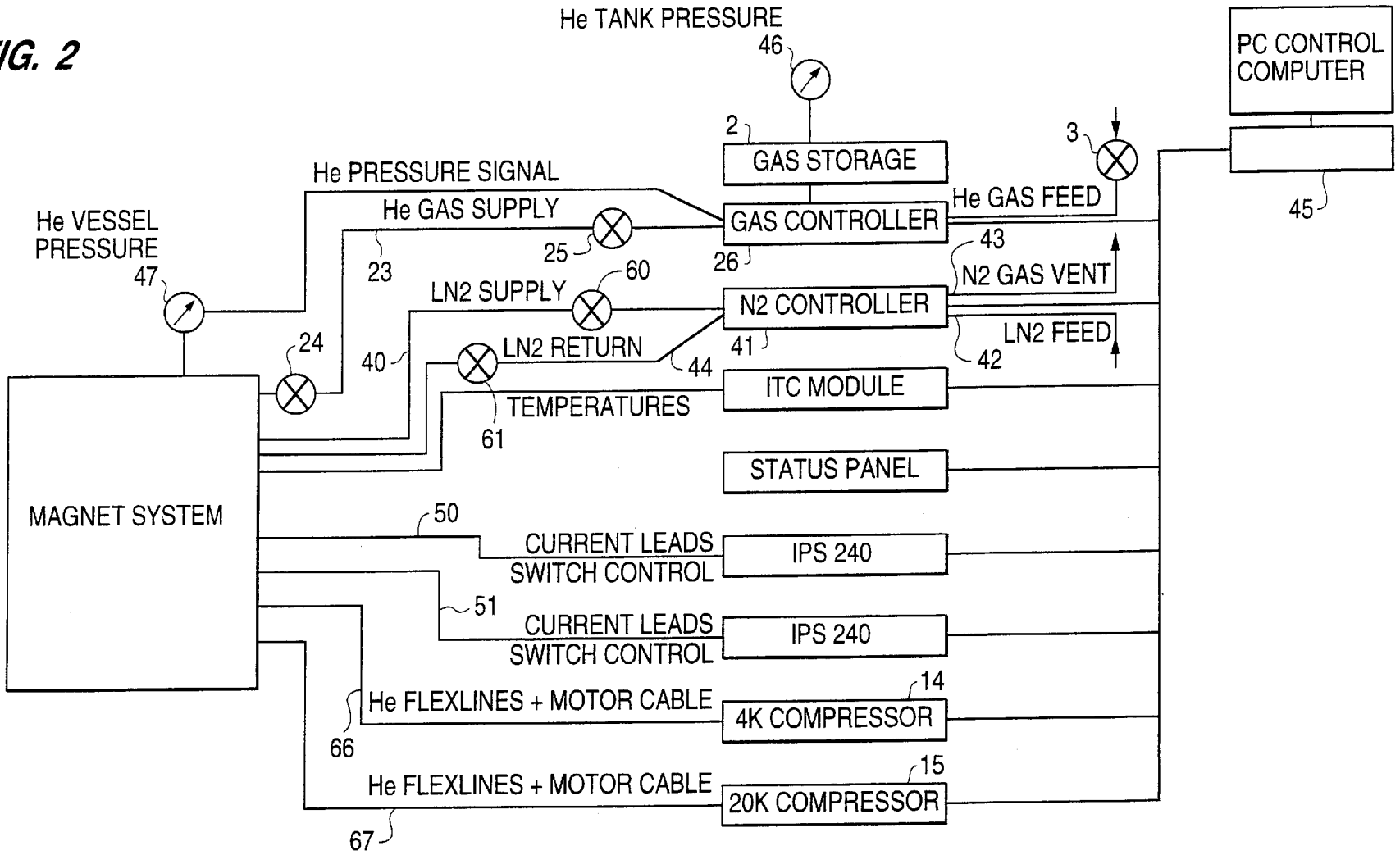
FIG. 2 is a second schematic diagram of the system of FIG. 1, showing the electronic and gas services.

Referring to FIG. 2, the compressors 14, 15 are connected to the cold heads 12,13 by respective helium flex lines 66,67. The flexlines 66,67 supply helium to the cold head from the compressor, and also return helium to the compressor from the cold head.

The flow of helium in helium gas supply line 23 is regulated by valves 24,25 which are controlled by gas controller 26. These valves are normally open to enable rapid expansion during magnet quench.

To accelerate the cool-down from room temperature to 4.2 K, liquid nitrogen can also be fed to pre-cooling heat exchangers which are in thermal contact with the magnet and radiation shield (described below). The liquid nitrogen is fed from liquid nitrogen supply line 40 under control of liquid nitrogen controller 41. The liquid nitrogen controller 41 receives liquid nitrogen from dewar 5 via feed line 42, and vents nitrogen gas via vent 43. Nitrogen is returned to the nitrogen controller 41 by return line 44.

The compressors 14,15 and controllers 26,41 are controlled by a PC 45. The pressure of the gas storage tank 2 can be monitored by a pressure gauge 46 and the pressure of the helium compartments 34,35 (shown in FIGS. 4 and 5) can be monitored by a pressure gauge 47.

Figure 3:
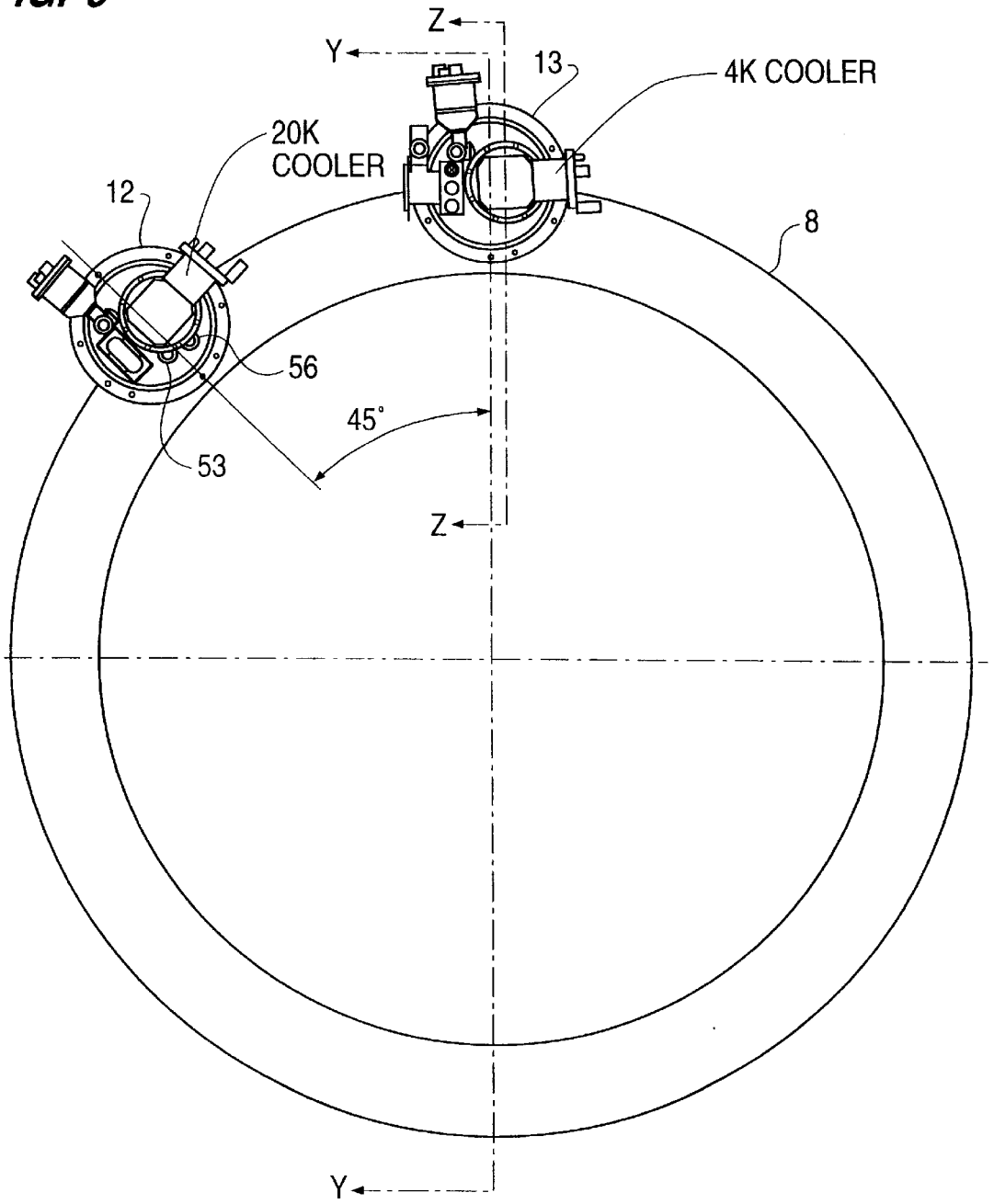
FIG. 3 is a plan view of the magnet system.
Figure 4:
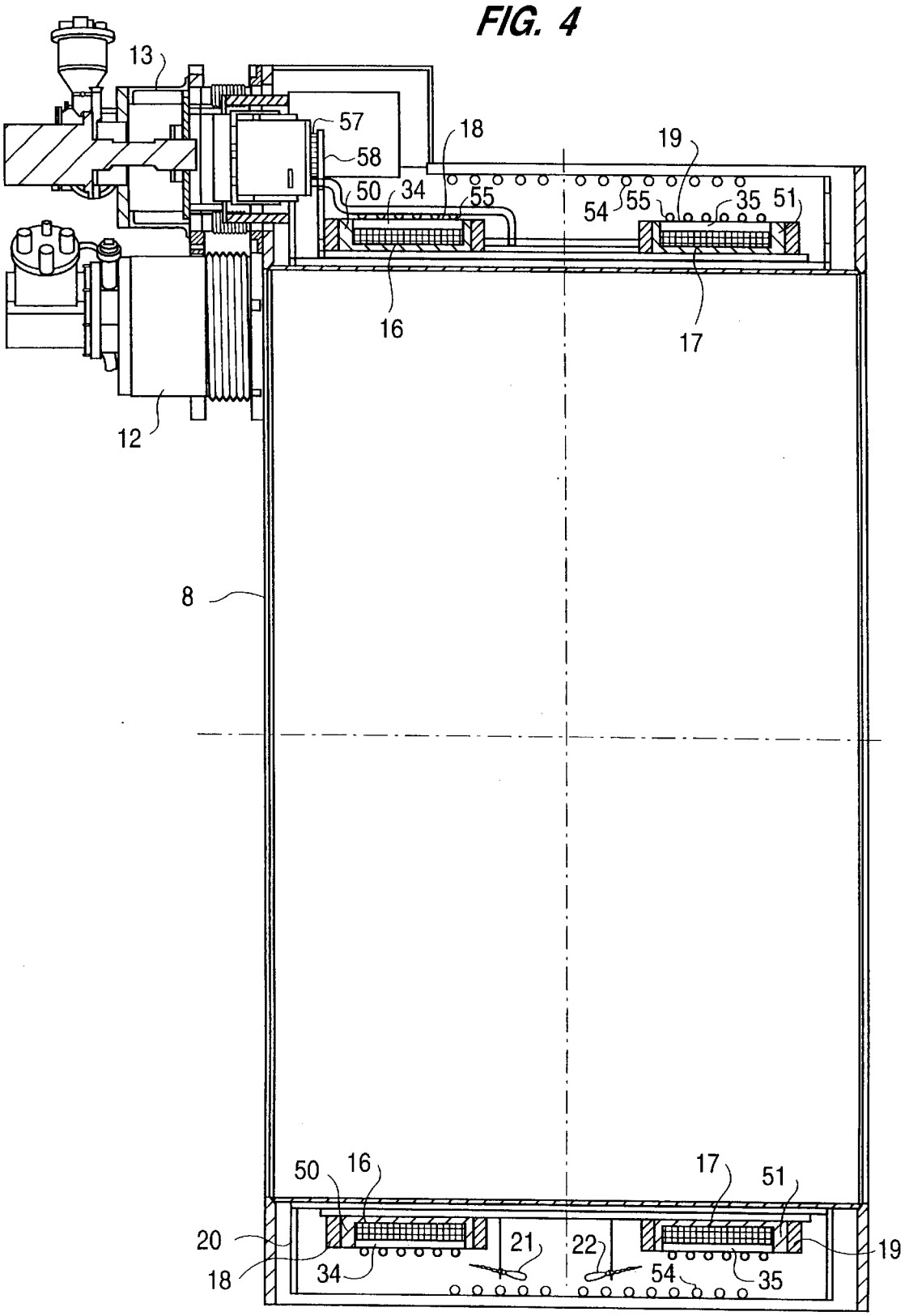
FIG. 4 is a cross-section along line Y—Y in FIG. 3.
Figure 5:
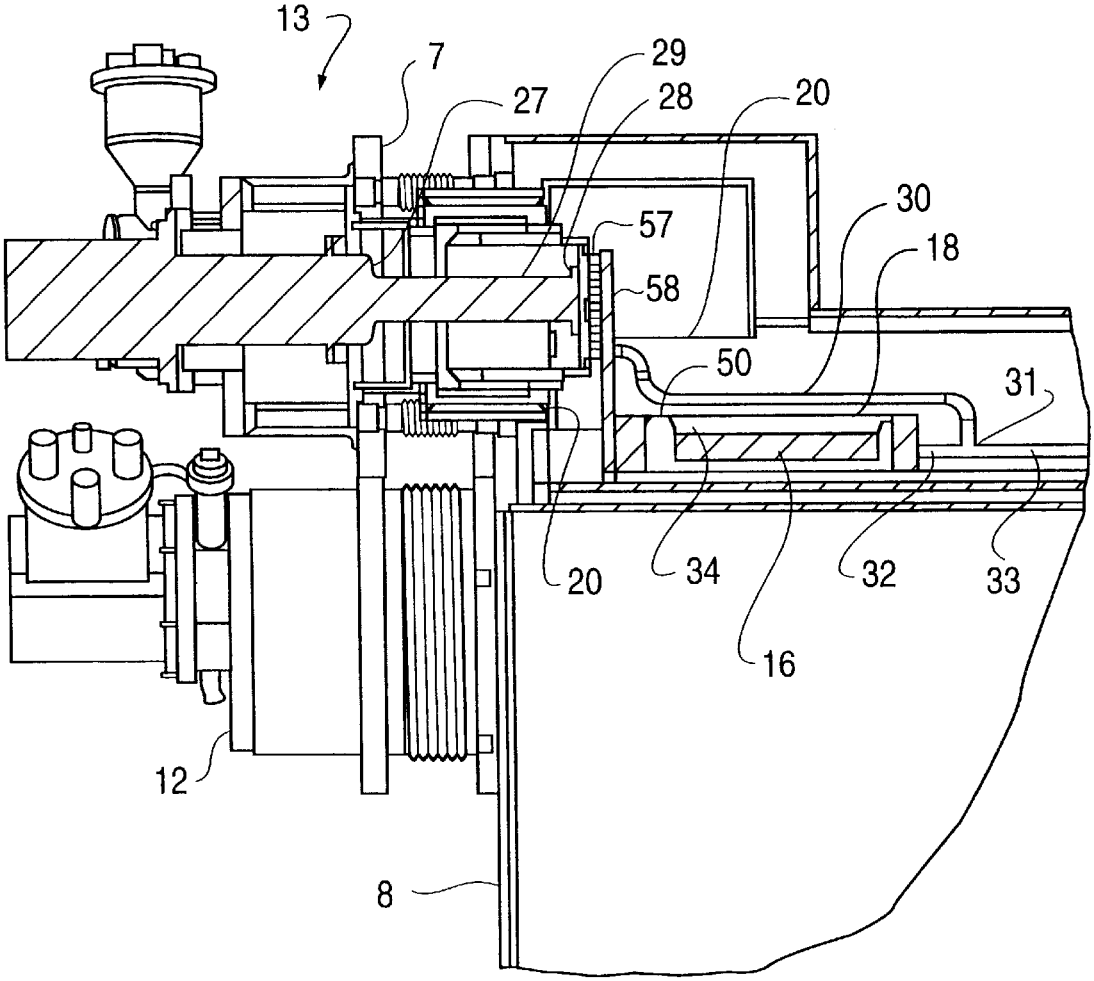
FIG. 5 is a cross-section through line Z—Z in FIG. 3, showing the 4 K cryocooler.

Referring now to FIGS. 3–5, the superconducting magnet comprises a pair of serially connected superconducting NbTi magnet coils 16,17. Each coil 16,17 is wound in a U-shaped groove running round the edge of a respective aluminium former 50,51. The aluminium formers 50,51 are each bolted and welded to a respective stainless steel or copper magnet vessel 18,19. A superconducting magnet switch (not shown) is also housed in one of the magnet vessels 18,19. The magnet vessels 18,19 are suspended on struts 21,22 inside a radiation shield 20. The radiation shield 20 shields the magnet and superconducting switch from 300 K radiation. The radiation shield 20 is housed inside an outer vacuum casing 8 which provides vacuum insulation and acts as the external interface of the system.

Each coil 16,17 has an inner diameter of 1890 mm, an outer diameter of 1960 mm and a width (from left to right in FIGS. 4 and 5) of 200 mm. Therefore the area of magnet which is wetted by liquid helium is $1.96\ m \times \pi \times 0.2\ m = 1.23\ m^2$.

The coils generate a magnet field of 0.25 T.

Liquid nitrogen from supply line 40 is fed into an inlet port 53 (FIG. 3) in the turret containing the 20 K cooler. Inlet port 53 leads to a heat exchanger comprising a continuous length of 6–10 mm OD tube which is wound inside the radiation shield 20 as indicated at 54, and wound outside the magnet vessels 18,19 as indicated at 55. Liquid nitrogen from the heat exchanger exits to return line 44 via outlet port 56 (FIG. 3).

Referring to FIG. 5 (which shows the 4 K cryocooler cold head 13) the cold head 13 has a first cold station 27 and a second cold station 28 provided in a cooling chamber 29. The cryocooler produces continuous closed-cycle refrigeration at temperatures depending upon the heat load imposed, in the range of 25 K to 40 K for the first stage cold station 27 and in the range of 3.5 K to 4.2 K for the second stage cold station 28. The cold heads 12,13 each have conductive connections with the radiation shield 20, and therefore cool the radiation shield by conduction.

The helium supply line 23 is connected to the cold head 13 via input 7. The input 7 is in fluid communication with the cooling chamber 29. The cooling chamber 29 is also in fluid communication with a supply line 30 which leads to a T-junction 31. The supply lines 32,33 from the T-junction 31 each communicate with helium chambers 34,35 between the magnets 16,17 and the inner periphery of their respective magnet vessel 18,19. Therefore the helium chambers 34,35 are each in fluid communication with the storage tank 2 via the 4 K cold head 13. The space between the magnet coils 16,17 and the inner periphery of their respective magnet vessel is of the order of 1–5 mm, and the volume of each helium chamber 34,35 is of the order of 1 liter.

A solid high thermal conductivity link is provided between the cold stage 28 and the coils 16,17 by a number of strands of copper braid 57 which are attached to a copper flange 58.

The cold head 13 also contains current leads (not shown) to run the magnet, and leads (not shown) for operating the superconducting switch. The current leads for the magnet can be either brass or preferably high temperature superconductor.

The system is cooled down from room temperature by the following method.

1. First it is necessary to reduce the pressure in the outer vacuum casing 8 to $1 \times 10^{-4}$ mbar using a suitable vacuum pump (not shown). After the initial pump-down the vacuum integrity is maintained by sorption pumps (not shown).

2. The cryocoolers 12–15 are switched on.

3. The liquid nitrogen supply valve 60 is opened.

4. The liquid nitrogen controller 41 pumps liquid nitrogen around the magnet vessels 18,19 and the radiation shield 20 via the pre-cooling heat exchangers 54,55. This cools the radiation shield 20 and the superconducting magnet coils 16,17.

5. The liquid nitrogen supply valve 60 is closed and the return valve 61 is opened.

6. The liquid nitrogen is removed from the system by purging from the vent side with helium gas. This siphons the residual liquid nitrogen from the pre-cooling heat exchangers back to the liquid nitrogen storage dewar 5. It is necessary to remove the liquid nitrogen as it will become frozen solid on the radiation shield 20 and magnet coils 16,17 when they cool below the solidification point. In addition Nitrogen has a significant thermal mass which is not really useful so cold head cooling power is wasted cooling it down.

7. The magnet is cooled by conduction through solid thermally conductive attachments with the cold heads 12,13 (i.e. through the flange 58 and braids 57) and through convection and conduction in the helium gas surrounding the magnet—ie. the helium gas in the helium chambers 34,35 and along supply lines 31,32,33 provides a path for transfer of heat from the magnet coils 16,17 to the cooling chamber 29.

8. As the second cold stage 28 reduces below the helium saturation temperature at the current gas pressure, condensation of liquid helium occurs at the second cold stage 28. Liquid helium then runs along supply line 31 and passes into the helium chambers 34,35 via supply line 32,33.

9. As the temperature reduces further and condensation of liquid helium continues, the magnet coils 16,17 and superconducting switch (not shown) are first wetted by the liquid helium and eventually fully immersed in liquid helium.

10. Condensation continues until the pressure becomes equal to the helium saturation pressure at which point condensation will cease. At this point the gas storage tank 2 will be at room temperature at a reduced pressure.

11. The magnet coils 16,17 and superconducting switch are now at approximately 4 K and can be operated in a conventional way.

The time required to completely cool the system from room temperature to 4.2 K using liquid nitrogen pre-cooling of the system is approximately 24 hours per tonne of magnet.

Figure 6:
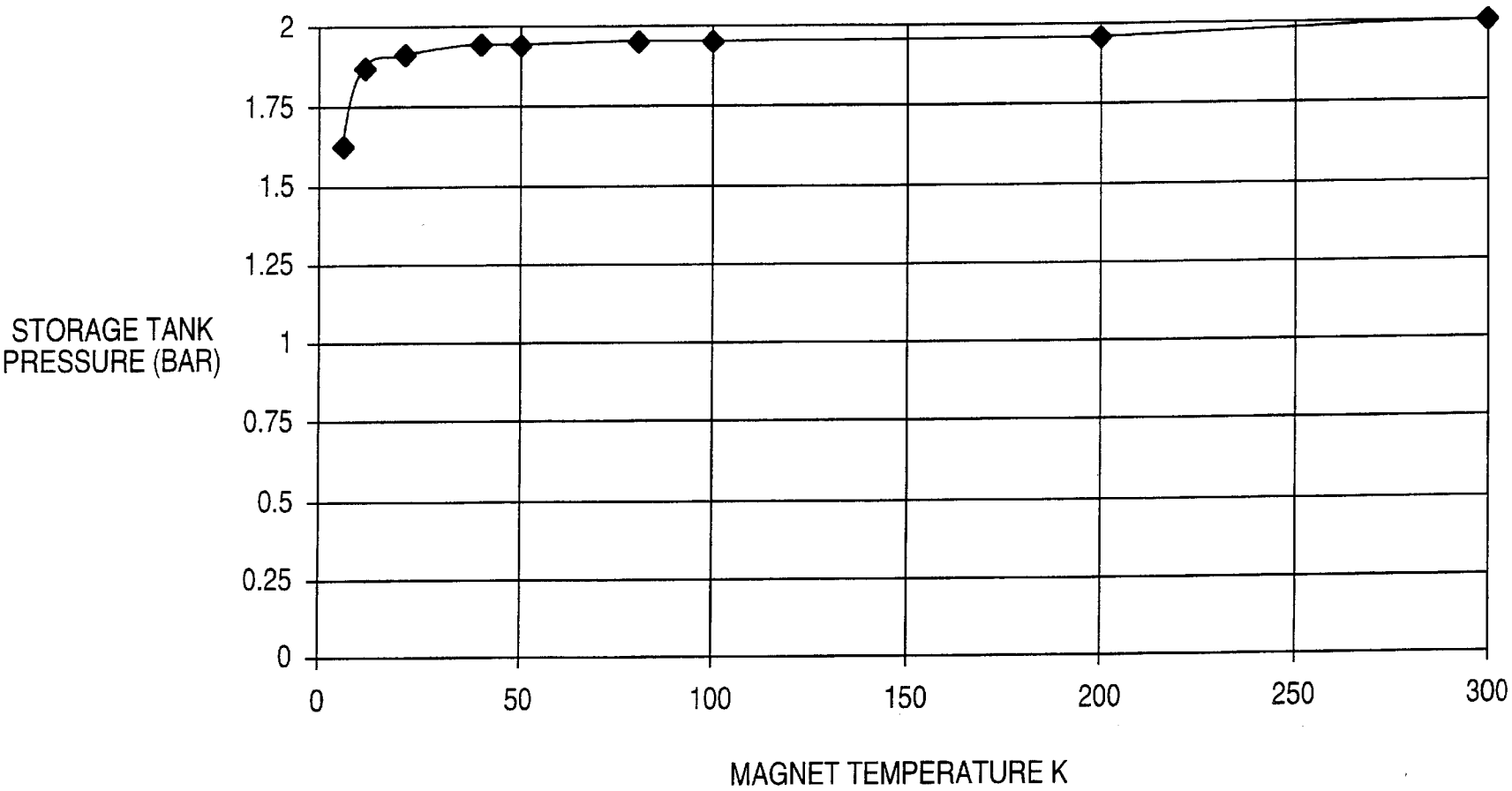
FIG. 6 is a graph showing the pressure of the helium gas storage tank vs temperature of the magnet.

The pressure of the storage tank 2 vs temperature of the magnet is shown in FIG. 6. As can be seen, the pressure is greater than 1 bar and typically lies between 1 and 2 bar. The pressures will be substantially the same everywhere in the helium circuit (i.e. in the storage tank 2, the cooling chamber 29, the supply lines 30,32,33 and the helium chambers 34,35) during normal operation. However a separate pressure gauge 47 for the helium chambers 34,35 is required when the helium gas supply line 23 is disconnected during servicing. Before reconnection the pressures in the helium chambers 34,35 and in the storage tank 2 are equalised with reference to the pressure gauges 46,47.

Any hot spots on the magnet coils 16,17 (which may be generated by eddy currents etc.) are rapidly cooled by conduction and convection in the liquid helium and by the latent heat of evaporation of the liquid helium. Any helium evaporated in the process will be recondensed later when the magnet is in persistent mode.

In the event of a power failure (or if the 4 K cryocooler 13,14 must be replaced or repaired), the approximate time to magnet quench will be of the order of one hour depending on the total helium volume and cryostat configuration. While the power is reconnected (or the 4 K cryocooler 13,14 is replaced or repaired) the magnet can be maintained in persistent mode while at a stationary preselected field and will continue to operate as long as it is kept cold.

We claim:

1. A refrigerator for cooling a sample comprising:

a reservoir for storing gaseous $^4$He;

a cooler for cooling gaseous $^4$He from the reservoir; and a helium vessel in fluid communication with said reservoir via said cooler, for receiving $^4$He from the reservoir, and wherein the sample is mounted in thermal contact with the $^4$He in said helium vessel whereby the $^4$He in the helium vessel provides a path for heat to transfer from the sample to said cooler.

2. A refrigerator according to claim 1 wherein said cooler has sufficient cooling power to cause gaseous $^4$He to condense and flow into said helium vessel.

3. A refrigerator according to claim 2 wherein the volumes of said helium vessel and said reservoir are chosen such that the total volume of liquid $^4$He which flows into said helium vessel does not exceed 5 liters.

4. A refrigerator according to claim 3 wherein the volumes of said helium vessel and said reservoir are chosen such that the total volume of liquid $^4$He which flows into said helium vessel does not exceed 2 liters.

5. A refrigerator according to claim 1, wherein the sample is housed in said helium vessel.

6. A refrigerator according to claim 1, wherein said cooler comprises a closed-cycle cryogenic cooler.

7. A refrigerator according to claim 6 wherein said cooler comprises a Gifford-McMahon cycle cryogenic cooler.

8. A refrigerator according to claim 1, further comprising a radiation shield which shields the sample from external radiation.

9. A refrigerator according to claim 1, wherein said cooler cools said radiation shield.

10. A refrigerator according to claim 1, further comprising a liquid nitrogen precooling system for precooling of said refrigerator with liquid nitrogen.

11. A refrigerator according to claim 8, further comprising a liquid nitrogen precooling system for precooling of said refrigerator with liquid nitrogen, wherein the liquid nitrogen precooling system precools said radiation shield.

12. A refrigerator according to claim 10, wherein said liquid nitrogen precooling system precools the sample.

13. A refrigerator according to claim 1, further comprising at least one additional cooler for cooling the sample and/or said radiation shield.

14. A refrigerator according to claim 1, wherein the volume of said helium vessel is chosen such that the total volume of $^4$He in use in the helium vessel is less than 5 liters.

15. A refrigerator according to claim 14 wherein the volume of said helium vessel is chosen such that the total volume of $^4$He in said helium vessel is less than 2 liters.

16. A refrigerator according to claim 1, further comprising a solid thermally conductive link which provides an additional path for heat to transfer from the sample to said cooler.

17. Apparatus for generating a magnetic field comprising a refrigerator according to claim 1; and a superconducting magnet mounted in thermal contact with the $^4$He in said helium vessel whereby the $^4$He in the helium vessel provides a path for heat to transfer from the sample to the cooler.

18. Apparatus according to claim 17 further comprising at least one current lead connected to said superconducting magnet, wherein said at least one current lead is at least partially manufactured from high temperature superconductor.

19. A refrigerator according to claim 1 wherein said reservoir for storing gaseous $^4$He is a room temperature reservoir.

20. A method of cooling a sample comprising providing a reservoir of gaseous $^4$He; cooling gaseous $^4$He from the reservoir with a cooler; providing $^4$He in a helium vessel; mounting a sample in thermal contact with the $^4$He in the helium vessel; and transferring heat from the sample to the cooler along a path provided by the $^4$He in the helium vessel.

21. A method of generating a magnetic field comprising providing a reservoir of gaseous $^4$He; cooling gaseous $^4$He from the reservoir with a cooler; providing $^4$He in a helium vessel; mounting a superconducting magnet in thermal contact with the $^4$He in the helium vessel; and transferring heat from the superconducting magnet to the cooler along a path provided by the $^4$He in the helium vessel.

* * * * *